US006795645B2

(12) United States Patent
Hygema et al.

(10) Patent No.: US 6,795,645 B2
(45) Date of Patent: Sep. 21, 2004

(54) HEATED FLUID DISPENSER

(75) Inventors: Terry L. Hygema, North Webster, IN (US); Larry R. Wolf, Avilla, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/353,643

(22) Filed: Jan. 29, 2003

(65) Prior Publication Data

US 2003/0142966 A1 Jul. 31, 2003

Related U.S. Application Data

(60) Provisional application No. 60/352,607, filed on Jan. 29, 2002, and provisional application No. 60/376,783, filed on Apr. 30, 2002.

(51) Int. Cl.[7] ..... B05B 1/24
(52) U.S. Cl. ..... 392/477; 222/146.1; 219/214
(58) Field of Search ..... 392/477, 466, 392/465; 222/146.1, 146.5; 219/214, 200

(56) References Cited

U.S. PATENT DOCUMENTS 3,338,476 A * 8/1967 Marcoux ..... 222/146.3
3,644,707 A * 2/1972 Costello ..... 392/341
3,891,827 A * 6/1975 Wyse ..... 392/477
3,933,276 A 1/1976 Packham et al. ..... 222/146
3,990,612 A 11/1976 Gasser ..... 222/146
3,997,083 A * 12/1976 McNair ..... 222/146.3
4,056,707 A * 11/1977 Farnam ..... 392/466
4,253,013 A 2/1981 Mabuchi ..... 219/521
5,780,819 A 7/1998 Fabrikant et al. ..... 219/535
5,786,573 A 7/1998 Fabrikant et al. ..... 219/535
5,811,766 A 9/1998 Fabrikant et al. ..... 219/535
6,311,868 B1 11/2001 Krietemier et al. ..... 222/1
6,454,127 B1 9/2002 Suomela et al. ..... 222/54

* cited by examiner

*Primary Examiner*—Thor Campbell
(74) *Attorney, Agent, or Firm*—Taylor & Aust, P.C.

(57) ABSTRACT

A heated fluid dispensing system including a heated dispenser and a docking element. The heated dispenser includes a housing with a docking interface, a channel heat exchanger disposed in the housing and an electrical heater associated with the channel heat exchanger. The channel heat exchanger has a channel in fluid communication with a valve on an aerosol can. The docking element includes a flange and a housing interface, the flange attachable to a cap ring on an aerosol can, the housing interface is both releasably attachable to and actuatable with the docking interface.

31 Claims, 6 Drawing Sheets

HEATED FLUID DISPENSER

CROSS REFERENCE TO RELATED APPLICATIONS

This is a non-provisional application based upon U.S. provisional patent application serial No. 60/352,607, entitled "LIQUID AND CREAM WARMER", filed Jan. 29, 2002 and also based upon U.S. provisional patent application serial No. 60/376,783, entitled "LIQUID, CREAM AND FOAM WARMER", filed Apr. 30, 2002.

BACKGROUND OF THE INVENTION

1. Field of the Invention

The present invention relates to heated fluid dispensers, and, more particularly, to a heated fluid dispenser used with an aerosol can which dispenses liquid, cream or foam.

2. Description of the Related Art

A closer, more comfortable shave is obtained with warm shaving cream or foam. Additionally, other fluids such as skin lotions are more comfortable to the touch when applied at an elevated temperature. Many such fluids are available in an aerosol container which provides dispensing convenience but no convenient warming capability.

Heating devices are known and used with aerosol cans which contain the aerosol can within the device housing or otherwise hold the can. These devices tend to be relatively bulky, complex and correspondingly expensive. Such devices take up counter space and are typically too large to fit into a bathroom's cabinet where such aerosol cans are normally stored. Heating devices which contain the can typically require a specific type and size can thereby restricting its use if a user's preference changes, for example, with respect to a particular shave cream. Further, such devices are not convenient for travel. Yet further, such devices may be required to be connected to a source of power when in use.

Other heating devices are known to connect to an aerosol can but do not provide adequate heating of the liquid, or require a cord connection to a source of power during use, or do not adequately connect to the can.

What is needed in the art is a heated fluid dispensing system which adequately connects to a variety of aerosol containers or cans, easily disconnects from the aerosol can for convenient storage of the can and heated dispenser, provides adequate heating of the fluid and does not need to be connected to a source of power during use.

SUMMARY OF THE INVENTION

The present invention provides a heated fluid dispensing system with a heated dispenser and a docking element that connects to a wide variety of aerosol cans.

The invention comprises, in one form thereof, a heated fluid dispensing system including a heated dispenser and a docking element. The heated dispenser includes a housing with a docking interface, a channel heat exchanger disposed in the housing and an electrical heater associated with the channel heat exchanger. The channel heat exchanger has a channel in fluid communication with a valve on an aerosol can. The docking element includes a flange and a housing interface, the flange attachable to a cap ring on an aerosol can, the housing interface is both releasably attachable to and actuatable with the docking interface.

An advantage of the present invention is the ability to use the heated fluid dispensing system with a variety of aerosol cans.

Another advantage is the present invention is easily disconnected from an aerosol can for convenient storage of the can and the heated dispenser.

Yet another advantage of the present invention is improved heating of the fluid.

Yet another advantage is the present invention does not need to be connected to a source of power during use.

Yet another advantage is the present invention is a reliable design that is cost effective to manufacture.

Yet another advantage is the present invention has minimized the number of moving parts.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
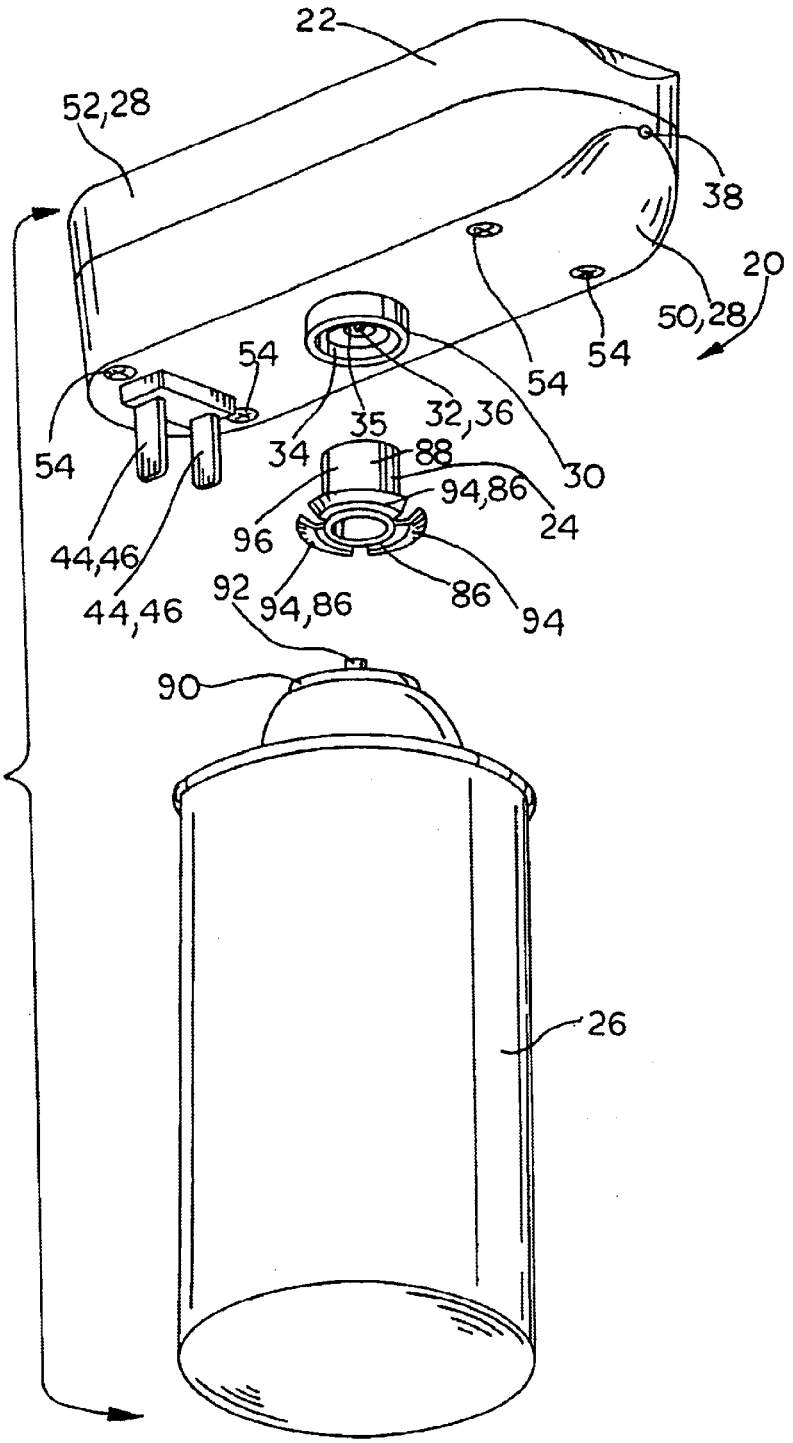
FIG. 1 is an an exploded perspective view of an embodiment of the heated fluid dispensing system of the present invention showing the heated dispenser, docking element and an aerosol can.
Figure 2:
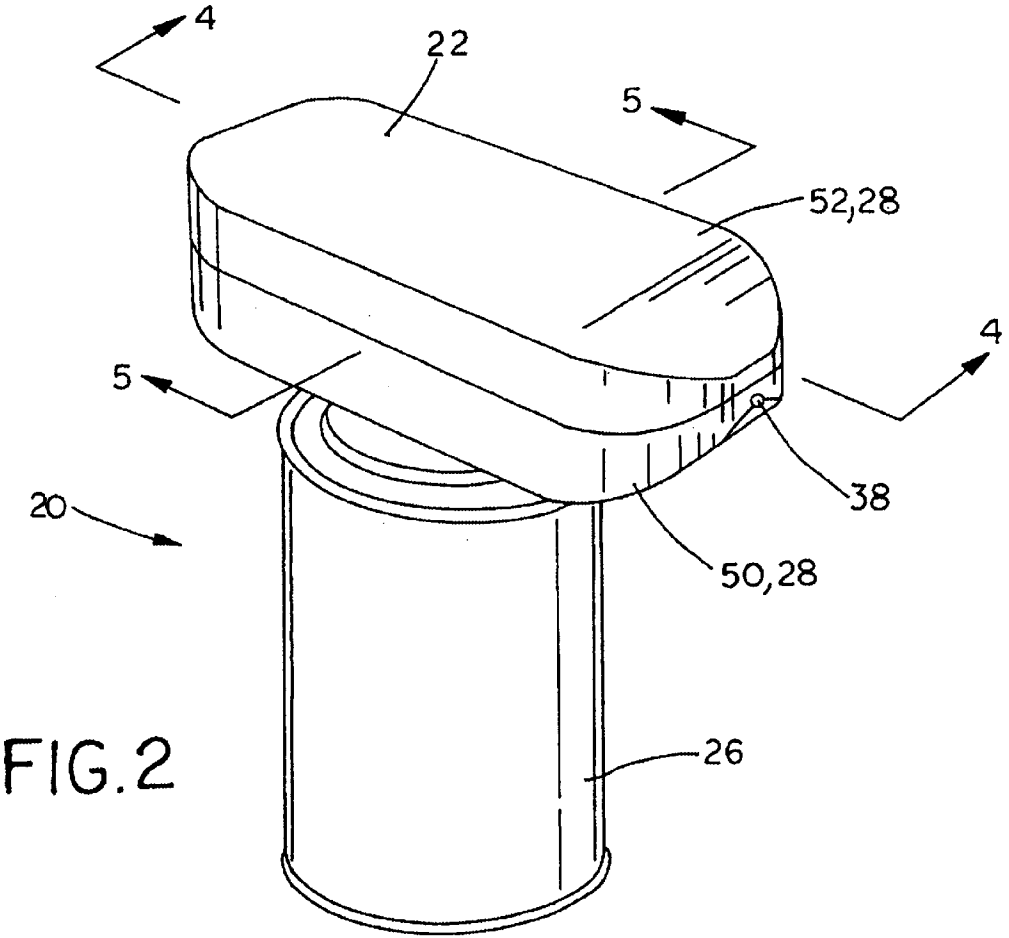
FIG. 2 is a perspective view of the system of FIG. 1 showing the heated dispenser mounted to the aerosol can.

Referring now to the drawings, and more particularly to FIG. 1, there is shown a heated fluid dispenser 20 which generally includes a heated dispenser 22 and a docking element 24 which connects to an aerosol can 26.

Figure 4:
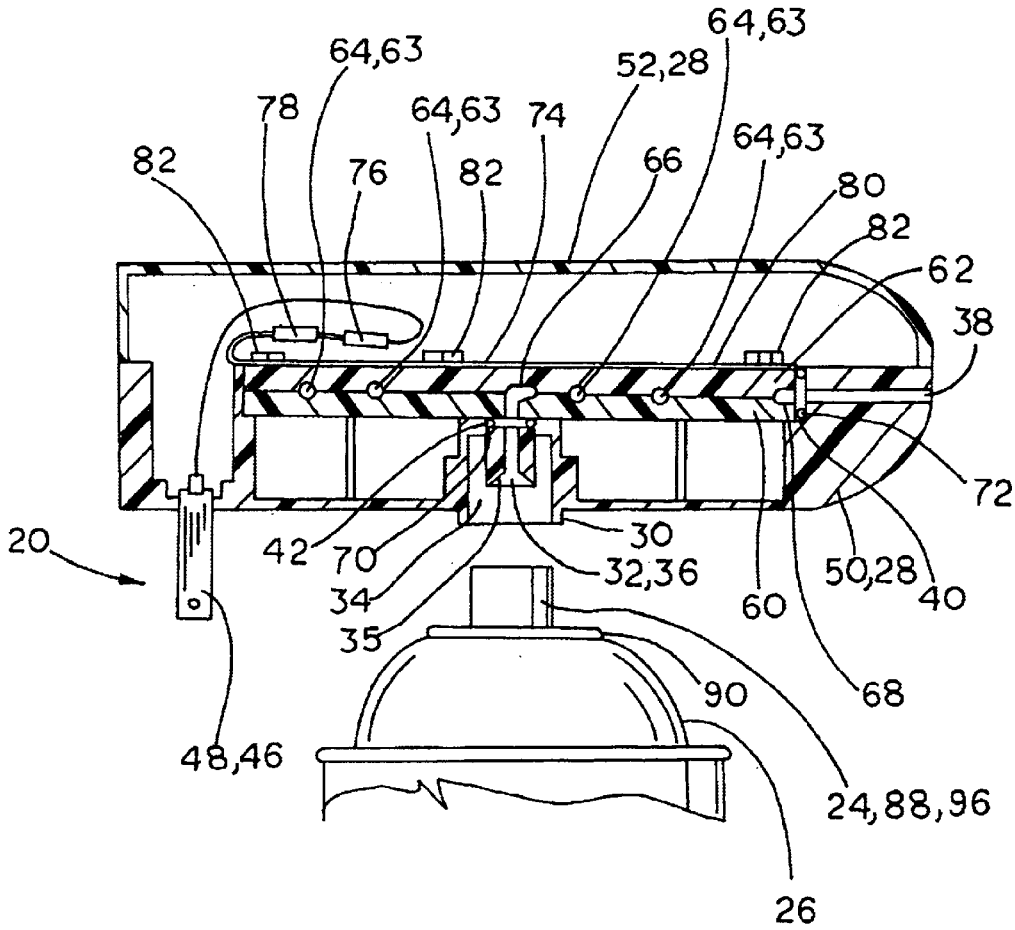
FIG. 4 is a cross-sectional view of the system of FIG. 2 taken along section line 4—4.
Figure 5:
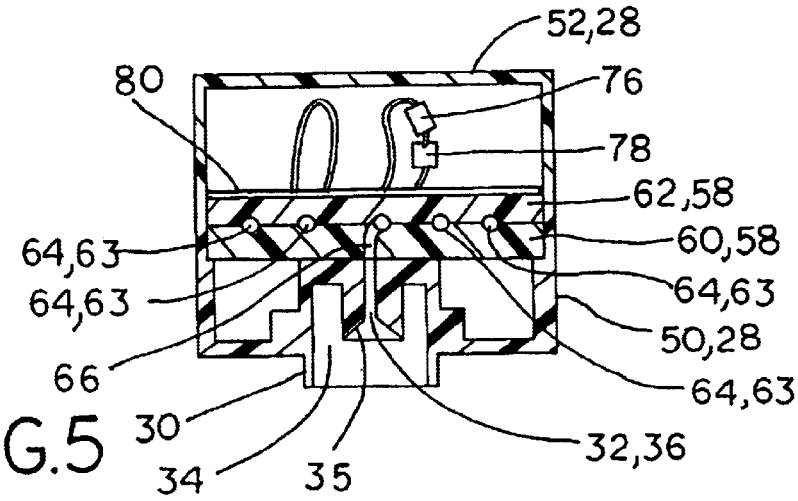
FIG. 5 is a cross-sectional view of the system of FIG. 2 taken along section line 5—5.

Heated dispenser 22 includes housing 28 with docking interface 30. Housing inlet 32 is within docking interface 30 and has recess 34 with flow restriction 36 therein. Flow restriction 36 can be an orifice, a region of reduced cross-section in housing inlet 32 or the like. Valve recess 35 interfaces with orifice 36 and can have a frustoconcical shape as shown in FIGS. 4 and 5, or can have a cylindrical shape (not shown) or can have a combination of cylindrical and frustoconical or other shapes. Housing 28 further includes housing outlet 38 in fluid commnunication with first O-ring groove 40 as shown in FIG. 4. Alternatively, flow restriction 36 can be in housing outlet 38. Second O-ring groove 42 is in fluid communication with housing inlet 32, and particularly, orifice 36. Plug apertures 44 allow plug 46, and particularly plug prongs 48 to extend through first housing half 50. First housing half 50 and second housing half 52 are shown as being joined by screw 54 (four) through housing holes 56, however, a variety of joining elements can be used such as nuts and bolts, rivets, welding, adhesives and snap-fit construction.

Figure 3:
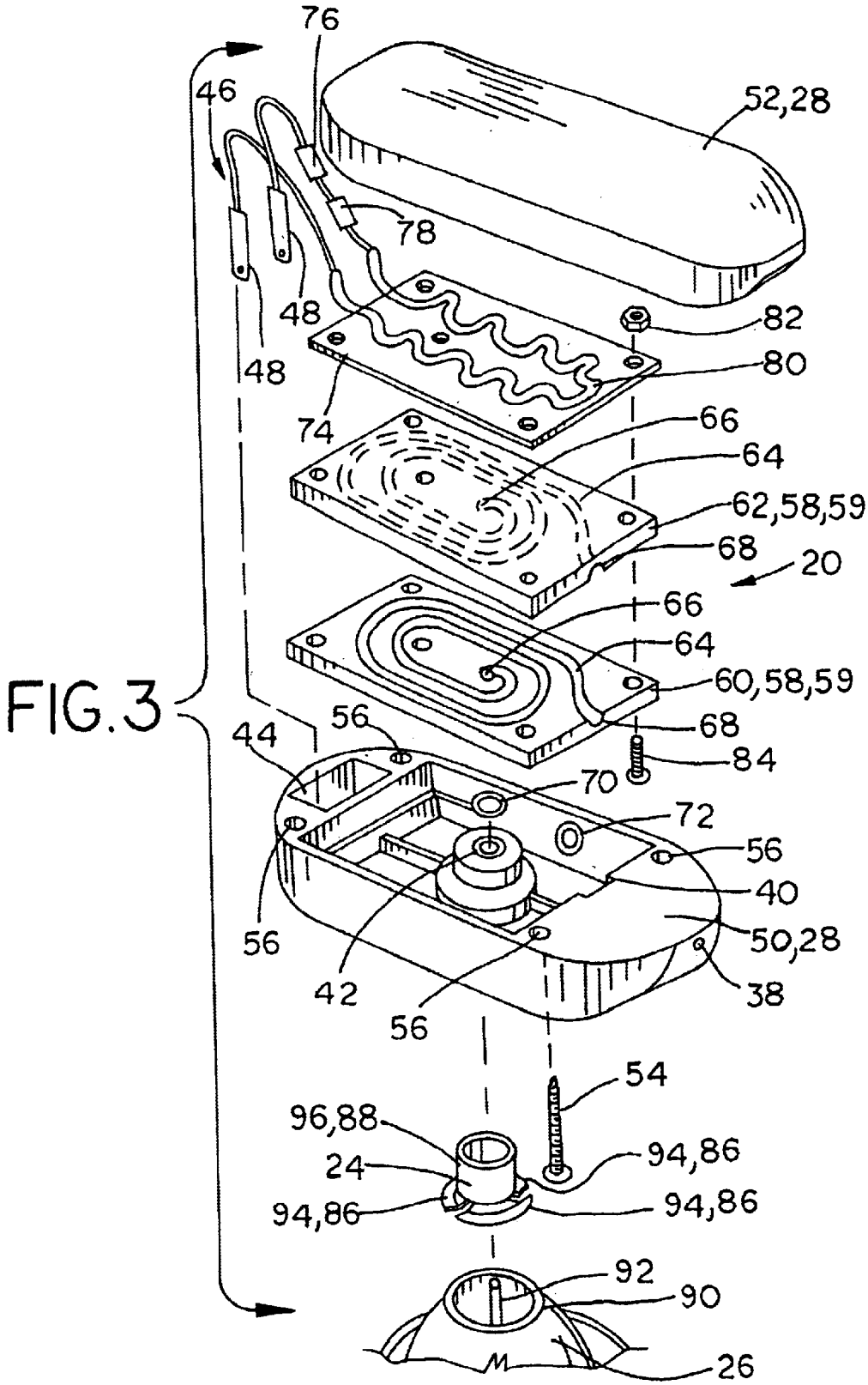
FIG. 3 is an exploded perspective view of the system of FIG. 1 showing the heated dispenser details.
Figure 6:
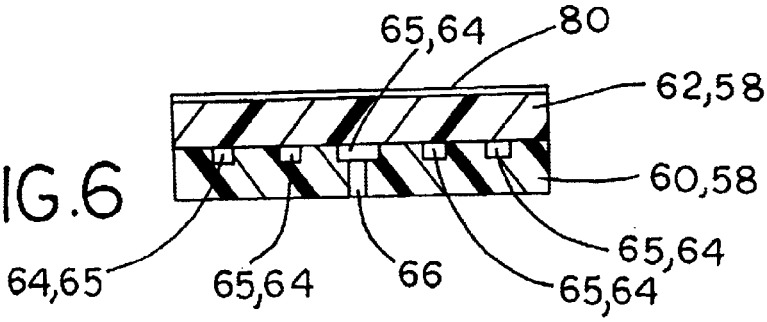
FIG. 6 is another embodiment of the channel heat exchanger of FIG. 5 showing a rectangular channel cross-section.

Heated dispenser 22 further includes heat exchanger 58 disposed in housing 38. First channel plate 60 combined with second channel plate 62 form therebetween heat exchanger channel 64. As shown in FIG. 3, channel 64 can be in the shape of a spiraling oval, and as shown in FIGS. 5 and 6, can have circular channel cross-section 63 or rectangular channel cross-section 65, or a polygonal or curved cross-section or combination thereof. Rectangular channel cross-section 65 has the advantage of only requiring channel fabrication in one of the two channel plates 60, 62 and also has more channel surface area for a given cross-sectional area thereby providing greater heat transfer. Channel inlet 66 and channel outlet 68 are the termini of channel 64 and are in respective fluid communication with housing inlet 32 and housing outlet 38. Second O-ring 70 provides a fluid tight seal between channel inlet 66 and housing inlet 32. First O-ring 72 provides a fluid tight seal between channel outlet 68 and housing outlet 38.

An overall fluid channel for heated dispenser 22 includes housing inlet 32, channel 64 and housing outlet 38. Alternatively, channel 64 can include flow restriction 36, which can be an orifice in channel 64, a region of channel 64 of reduced cross-section or the like.

Electrical heater 74 is associated with heat exchanger 58. Electrical heater 74 includes plug 46 with plug prongs 48, fuse 76, thermostat 78 and resistive heating element 80 with these circuit elements connected in electrical series arrangement as shown. Resistive heating element 80 can be a flexible circuit board with a resistive ink, or other resistive material, imprinted thereon. First channel plate 60, second channel plate 62 and resistive heating element 80 are shown as being assembled using nut 82 (four) and bolt 84 (four), however, a variety of joining elements can be used such as screws, rivets, welding and adhesives. Additionally, a thin layer of conductive material (not shown) can be placed between first channel plate 60 and second channel plate 62, and second channel plate 62 and resistive heating element 80 to improve the heat transfer from resistive heating element 80 to second channel plate 62 and then to first channel plate 60. Electrical heater 74 can also include an indicator (not shown) such as an LED or other lamp that lights when heat exchanger 58 is at an appropriate temperature for sufficient heating of the dispensed fluid.

Alternatively, heat exchanger 58 can include a phase change material 59 for both storing heat, and also for releasing heat at a constant temperature when warming the fluid.

Docking element 24 includes flange 86 and housing interface 88. Flange 86 attaches to locating feature 90 of aerosol can 26. Locating feature 90 can also be a crimp, a cap ring or the like. Housing interface 88 both releasably attaches to and actuates with docking interface 30 of heated dispenser 22. Flange 86 can include segments 94 to allow for some strain relief when flange 86 is snap fit into cap ring 90. In one embodiment of docking element 24, cylinder 96 connects at one end thereof to flange 86, and the other end thereof both releasably attaches to and actuates with docking interface 30 of heated dispenser 22. This actuation can be in a direction of cylinder 96 longitudinal axis.

Figure 7:
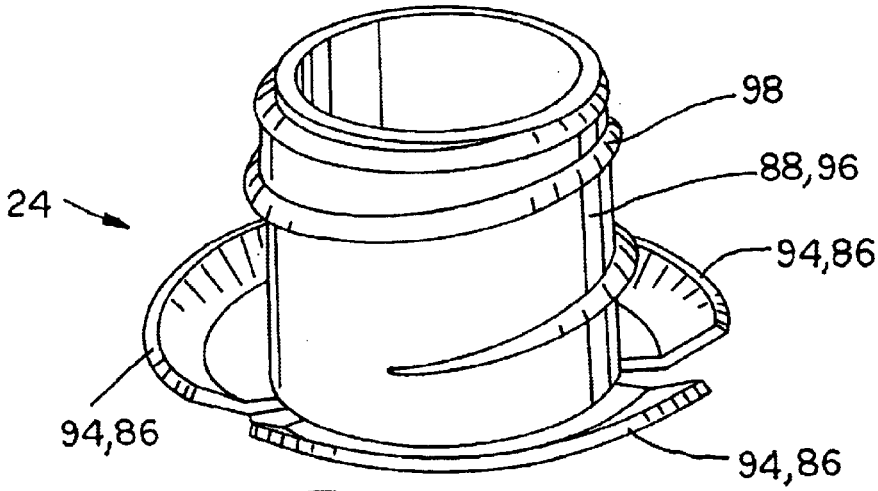
FIG. 7 is another embodiment of the docking element of the present invention showing a threaded version of the docking element.

In another embodiment of docking element 24 (FIG. 7), cylinder 96 includes external thread 98. Docking interface 30 has a complimentary internal thread (not shown). Mating external thread 98 with a complimentary internal thread on docking interface 30 allows heated dispenser 22 to actuate both in a direction of cylinder 96 longitudinal axis and also rotate about cylinder 96 longitudinal axis.

Figure 8:
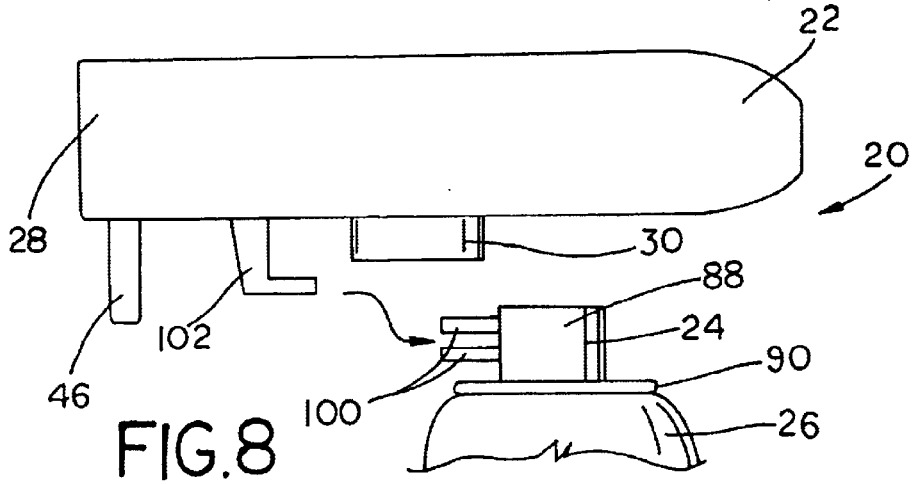
FIG. 8 is another embodiment of the docking element of the present invention showing a horizontally sliding version of the docking element.

In another embodiment of docking element 24 (FIG. 8), housing interface 88 includes first slide element 100. Housing 28 includes second slide element 102. Mating first slide element 100 with second slide element 102 allows heated dispenser 22 to actuate both in a direction of housing interface 88 longitudinal axis and also perpendicular to housing interface 88 longitudinal axis.

Figure 9:
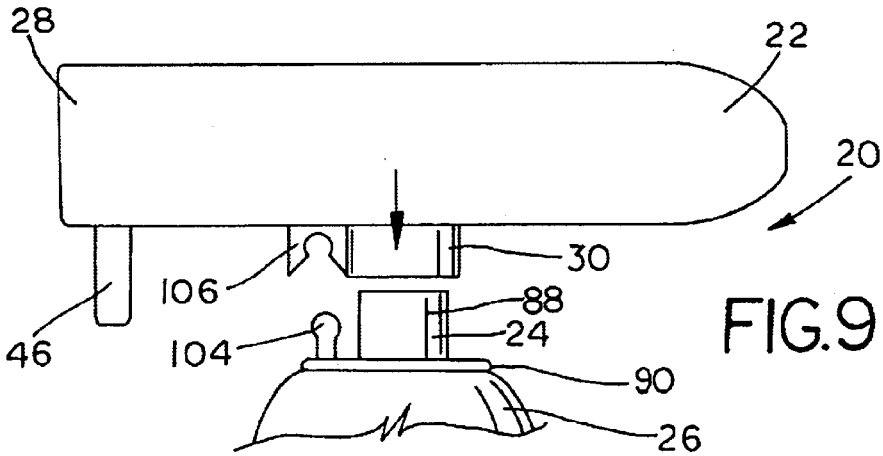
FIG. 9 is another embodiment of the docking element of the present invention showing a hinged version of the docking element.

In another embodiment of docking element 24 (FIG. 9), housing interface 88 includes first hinge element 104. Housing 28 includes second hinge element 106. Mating first hinge element 104 with second hinge element 106, respectively, allows heated dispenser 22 to actuate both in a direction of housing interface 88 longitudinal axis and also in a rotation perpendicular to housing interface 88 longitudinal axis.

Figure 10:
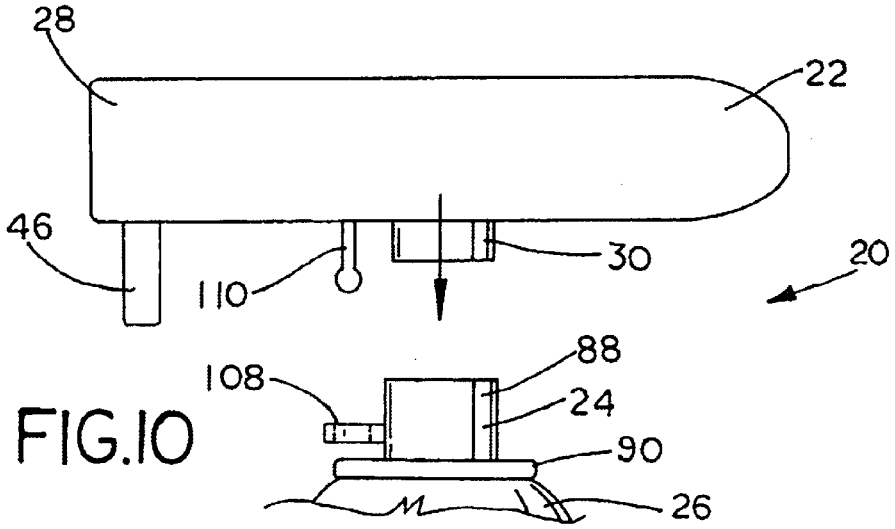
FIG. 10 is another embodiment of the docking element of the present invention showing a keyhole version of the docking element.

In another embodiment of docking element 24 (FIG. 10), housing interface 88 includes first keyhole element 108. Housing 28 includes second keyhole element 110. Mating first keyhole element 108 with second keyhole element 110 allows heated dispenser 22 to actuate respective to docking element 24.

In use, docking element 24 is attached to aerosol container 26. Heated dispenser 22 is connected to a source of power (not shown) for a predetermined time. Heated dispenser 22 is removed from the source of power. Heated dispenser 22 is attached to docking element 24. Heated dispenser 22 is actuated respective to docking element 24. A fluid (not shown) in aerosol container 26 is simultaneously heated and dispensed through heated dispenser 22.

Actuating heated dispenser 22 respective to docking element 24 engages valve recess 35 with dispensing valve 92. Further actuation of heated dispenser 22 by translation or rotation respective to docking element 24 opens valve 92 allowing the fluid to egress aerosol can 26 and ingress heated dispenser 22 via housing inlet 32, and particularly orifice 36. Through fluid communication of corresponding parts, the fluid motivates through channel heat exchanger 58 and ultimately housing outlet 38, the fluid being heated along the way. As has been just described, housing inlet 32 and channel 64 are in fluid communication with valve 92. Flow restriction 36 can be configured for reducing the flow of the fluid from valve 92 into channel 64 thereby allowing more time to heat the fluid with a resulting higher exit temperature for the fluid. Flow restriction 36, for example, can be an orifice with a diameter of between approximately 0.003 and 0.060 inch, and particularly, 0.006 inch.

Controlling the rate of fluid flow, and thereby controlling the exit temperature of the fluid is also achieved by controlling the relative actuation, either translational or rotational, of heated dispenser 22 respective to docking element 24. Less actuation of heated dispenser 22 results in less actuation of valve 92 thereby slowing the egress of the fluid from can 26 and resulting in a corresponding higher exit temperature of the fluid at housing outlet 38.

Alternatively, heat exchanger 58 can include a phase change material 59 for both storing heat, and also for releasing heat at a constant temperature when warming a dispensed fluid.

Docking element 24 allows for a sound connection of heated dispenser 22 to aerosol can 26, thereby not requiring a structural connection of heated dispenser 22 to valve 92; valve 92 is not a structural component per se. The present invention has the ability to use the heated fluid dispensing system 20 with a variety of aerosol cans 26. The present invention is easily disconnected from an aerosol can for convenient storage and portability of the can and heated dispenser 22. The present invention improves the heating of the fluid, in part, through the configuration of orifice 36 and also by controlled actuation of heated dispenser 22. The present invention does not need to be connected to a source of power during use. The present invention is a reliable design that is cost effective to manufacture and has minimized the number of moving parts.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heated fluid dispenser system, comprising:

an aerosol container including a locating feature and a valve;

a heated dispenser including:

a housing including a docking interface;

a heat exchanger disposed in said housing, said heat exchanger including a heat exhanger channel in fluid communication with said valve; and an electrical heater associated with said heat exchanger; and a docking element including a flange and a housing interface, said flange attached to said locating feature, said flange including a plurality of segments located circumferentially about said housing interface, said housing interface both releasably attached to and actuatable with said docking interface.

2. The heated fluid dispenser system of claim 1, wherein said locating feature is one of a cap ring and a crimp.

3. The heated fluid dispenser system of claim 1, wherein said heated dispenser includes a fluid channel including a housing inlet, a housing outlet and said heat exchanger channel therebetween, said housing inlet in fluid communication with said valve, said aerosol container includes a fluid, said fluid channel includes a flow restriction configured for reducing the flow of said fluid.

4. The heated fluid dispenser system of claim 3, wherein said flow restriction is an orifice in one of said housing inlet, said housing outlet and said heat exchange channel.

5. The heated fluid dispenser system of claim 3, wherein said fluid channel includes a region of reduced cross-section, said flow restriction is said region of reduced cross-section.

6. The heated fluid dispenser system of claim 1, wherein said housing interface includes a longitudinal axis, said heated dispenser is actuatable with said housing interface in a direction of said longitudinal axis.

7. The heated fluid dispenser system of claim 1, wherein said electrical heater includes a plug, a fuse, a thermostat and a resistive heating element, said plug, said fuse, said thermostat, and said resistive heating element connected in electrical series arrangement, said resistive heating element is a flexible circuit board with a resistive ink imprinted thereon.

8. The heated fluid dispenser system of claim 1, wherein said channel is in the shape of a spiraling oval.

9. A heated fluid dispenser system, comprising:

an aerosol container including a locating feature and a valve;

a heated dispenser including:

a housing including a docking interface;

a heat exchanger disposed in said housing, said heat exchanger including a heat exhanger channel in fluid communication with said valve, said heat exchanger includes a phase change material, said aerosol container includes a fluid, said phase change material for both storing heat, and also for releasing heat at a constant temperature when warming said fluid; and an electrical heater associated with said heat exchanger; and a docking element including a flange and a housing interface, said flange attached to said locating feature, said housing interface both releasably attached to and actuatable with said docking interface.

10. A heated fluid dispenser system, comprising:

an aerosol container including a locating feature and a valve;

a heated dispenser including:

a housing including a docking interface;

a heat exchanger disposed in said housing, said heat exchanger including a heat exhanger channel in fluid communication with said valve; and an electrical heater associated with said heat exchanger; and a docking element including a flange and a housing interface, said flange attached to said locating feature, said housing interface both releasably attached to and actuatable with said docking interface, said housing interface is a cylinder including a first end and a second end, said flange is connected to said housing interface at said first end, said second end releasably attached to and actuatable with said docking interface.

11. The heated fluid dispenser system of claim 10, wherein said cylinder includes an external thread, said docking interface includes a complimentary internal thread, said housing interface includes a longitudinal axis, said heated dispenser is actuatable with said housing interface in both a direction of said longitudinal axis and a rotation about said longitudinal axis.

12. A heated fluid dispenser system, comprising:

an aerosol container including a locating feature and a valve;

a heated dispenser including:

a housing including a docking interface;

a heat exchanger disposed in said housing, said heat exchanger including a heat exhanger channel in fluid communication with said valve; and an electrical heater associated with said heat exchanger; and a docking element including a flange and a housing interface, said flange attached to said locating feature, said housing interface both releasably attached to and actuatable with said docking interface, said housing interface includes a longitudinal axis and a first hinge element, said housing includes a second hinge element complimentary with said first hinge element, said heated dispenser is actuatable with said housing interface in both a direction of said longitudinal axis and a rotation about an axis perpendicular to said longitudinal axis.

13. A heated fluid dispenser system, comprising:

an aerosol container including a locating feature and a valve;

a heated dispenser including:

a housing including a docking interface;

a heat exchanger disposed in said housing, said heat exchanger including a heat exhanger channel in fluid communication with said valve; and an electrical heater associated with said heat exchanger; and a docking element including a flange and a housing interface, said flange attached to said locating feature, said housing interface both releasably attached to and actuatable with said docking interface, said housing interface includes a longitudinal axis and a first slide element, said housing includes a second slide element complimentary with said first slide element, said heated dispenser is actuatable with said housing interface in both a direction of said longitudinal axis and a direction perpendicular to said longitudinal axis.

14. A heated fluid dispenser for use with an aerosol container including a locating feature and a valve, said heated fluid dispenser comprising:

a heated dispenser including:

a housing including a docking interface;

a heat exchanger disposed in said housing, said heat exchanger including a heat exchanger channel for fluid communication with the valve; and an electrical heater associated with said heat exchanger; and a docking element including a flange and a housing interface, said flange attachable to the locating feature, said flange including a plurality of segments located circumferentially about said housing interface, said housing interface both releasably attachable to and actuatable with said docking interface.

15. The heated fluid dispenser system of claim 14, wherein the locating feature is one of a cap ring and a crimp.

16. The heated fluid dispenser system of claim 14, wherein said heated dispenser includes a fluid channel including a housing inlet, a housing outlet and said heat exchanger channel therebetween, said housing inlet for fluid communication with the valve, said aerosol container includes a fluid, said fluid channel includes a flow restriction configured for reducing the flow of said fluid.

17. The heated fluid dispenser system of claim 16, wherein said flow restriction is an orifice in one of said housing inlet, said housing outlet and said heat exchange channel.

18. The heated fluid dispenser system of claim 16, wherein said fluid channel includes a region of reduced cross-section, said flow restriction is said region of reduced cross-section.

19. The heated fluid dispenser of claim 14, wherein said electrical heater includes a plug, a fuse, a thermostat and a resistive heating element, said plug, said fuse, said thermostat, and said resistive heating element connected in electrical series arrangement, said resistive heating element is a flexible circuit board with a resistive ink imprinted thereon.

20. The heated fluid dispenser of claim 14, wherein said channel is in the shape of a spiraling oval.

21. The heated fluid dispenser of claim 14, wherein said housing interface includes a longitudinal axis, said heated dispenser is actuatable with said housing interface in a direction of said longitudinal axis.

22. A heated fluid dispenser for use with an aerosol container including a locating feature and a valve, said heated fluid dispenser comprising:

a heated dispenser including:

a housing including a docking interface;

a heat exchanger disposed in said housing, said heat exchanger including a heat exchanger channel for fluid communication with the valve, said heat exchanger includes a phase change material, said aerosol container includes a fluid, said phase change material for both storing heat, and also for releasing heat at a constant temperature when warming said fluid; and an electrical heater associated with said heat exchanger; and a docking element including a flange and a housing interface, said flange attachable to the locating feature, said housing interface both releasably attachable to and actuatable with said interface.

23. A heated fluid dispenser for use with an aerosol container including a locating feature and a valve, said heated fluid dispenser comprising:

a heated dispenser including:

a housing including a docking interface;

a heat exchanger disposed in said housing, said heat exchanger including a heat exchanger channel for fluid communication with the valve; and an electrical heater associated with said heat exchanger; and a docking element including a flange and a housing interface, said flange attachable to the locating feature, said housing interface both releasably attachable to and actuatable with said docking interface, said housing interface is a cylinder including a first end and a second end, said flange is connected to said housing interface at said first end, said second end releasably attachable to and actuatable with said docking interface.

24. The heated fluid dispenser of claim 23, wherein said cylinder includes an external thread, said docking interface includes a complimentary internal thread, said housing interface includes a longitudinal axis, said heated dispenser is actuatable with said housing interface in both a direction of said longitudinal axis and a rotation about said longitudinal axis.

25. A heated fluid dispenser for use with an aerosol container including a locating feature and a valve, said heated fluid dispenser comprising:

a heated dispenser including:

a housing including a docking interface;

a heat exchanger disposed in said housing, said heat exchanger including a heat exchanger channel for fluid communication with the valve; and an electrical heater associated with said heat exchanger; and a docking element including a flange and a housing interface, said flange attachable to the locating feature, said housing interface both releasably attachable to and actuatable with said docking interface, said housing interface includes a longitudinal axis and a first hinge element, said housing includes a second hinge element complimentary with said first hinge element, said heated dispenser is actuatable with said housing interface in both a direction of said longitudinal axis and a rotation about an axis perpendicular to said longitudinal axis.

26. A heated fluid dispenser for use with an aerosol container including a locating feature and a valve, said heated fluid dispenser comprising:

a heated dispenser including:

a housing including a docking interface;

a heat exchanger disposed in said housing, said heat exchanger including a heat exchanger channel for fluid communication with the valve; and an electrical heater associated with said heat exchanger; and a docking element including a flange and a housing interface, said flange attachable to the locating feature, said housing interface both releasably attachable to and actuatable with said docking interface, said housing interface includes a longitudinal axis and a first slide element, said housing includes a second slide element complimentary with said first slide element, said heated dispenser is actuatable with said housing interface in both a direction of said longitudinal axis and a direction perpendicular to said longitudinal axis.

27. A method of heating a fluid exiting an aerosol container, comprising the steps of:

attaching a docking element to the aerosol container, said docking element including a flange and a housing interface, said flange attached to said locating feature, said flange including a plurality of segments located circumferentially about said housing interface;

connecting a heated dispenser to a source of power for a predetermined time;

removing said heated dispenser from said source of power;

attaching said heated dispenser to said docking element;

actuating said heated dispenser respective to said docking element; and simultaneously heating and dispensing the fluid through said heated dispenser.

28. The method of claim 27, wherein said actuating step includes linear actuation of said heated dispenser respective to said docking element.

29. A method of heating a fluid exiting an aerosol container, comprising the steps of:

attaching a docking element to the aerosol container;

connecting a heated dispenser to a source of power for a predetermined time;

removing said heated dispenser from said source of power;

attaching said heated dispenser to said docking element;

actuating said heated dispenser respective to said docking element, said actuating step includes rotational actuation of said heated dispenser respective to said docking element; and simultaneously heating and dispensing the fluid through said heated dispenser.

30. A method of heating a fluid exiting an aerosol container, comprising the steps of:

attaching a docking element to the aerosol container;

connecting a heated dispenser to a source of power for a predetermined time;

removing said heated dispenser from said source of power;

attaching said heated dispenser to said docking element;

actuating said heated dispenser respective to said docking element, said actuating step includes both linear actuation and rotational actuation of said heated dispenser respective to said docking element; and simultaneously heating and dispensing the fluid through said heated dispenser.

31. A method of heating a fluid exiting an aerosol container, comprising the steps of:

attaching a docking element to the aerosol container;

connecting a heated dispenser to a source of power for a predetermined time;

removing said heated dispenser from said source of power;

attaching said heated dispenser to said docking element;

actuating said heated dispenser respective to said docking element,; and simultaneously heating and dispensing the fluid through said heated dispenser, said heated dispenser includes a phase change material, said phase change material releases heat to the fluid at an approximately constant temperature in said heating and dispensing step.

* * * * *